US008544832B2

(12) United States Patent
Richards et al.

(10) Patent No.: US 8,544,832 B2
(45) Date of Patent: Oct. 1, 2013

(54) OFFSET FOLDED NEWSPAPER STABILIZATION METHOD AND PRODUCT

(75) Inventors: John Sheridan Richards, Barrington, NH (US); Heiner Luxem, Durham, NH (US)

(73) Assignee: Goss International Americas, Inc., Durham, NH (US)

( * ) Notice: Subject to any disclaimer, the term of this patent is extended or adjusted under 35 U.S.C. 154(b) by 599 days.

(21) Appl. No.: 12/560,971

(22) Filed: Sep. 16, 2009

(65) Prior Publication Data

US 2010/0066003 A1 Mar. 18, 2010

Related U.S. Application Data

(60) Provisional application No. 61/192,183, filed on Sep. 16, 2008.

(51) Int. Cl.
*B41F 13/58* (2006.01)

(52) U.S. Cl.
USPC ..... 270/7; 270/5.01; 270/21.1; 493/421

(58) Field of Classification Search
USPC ..... 101/226, 227, 228; 493/419, 421; 270/4, 5.01, 5.02, 6, 7, 20.1, 21.1
See application file for complete search history.

(56) References Cited

U.S. PATENT DOCUMENTS

| | | | | | |
|---|---|---|---|---|---|
| 3,275,316 | A * | 9/1966 | Cleary, Jr. | ..... | 270/52.24 |
| 3,702,171 | A | 11/1972 | Levine | ..... | 229/79 |
| 4,997,126 | A * | 3/1991 | Amoss | ..... | 229/92.8 |
| 5,060,847 | A * | 10/1991 | Angus | ..... | 229/70 |
| 5,632,476 | A * | 5/1997 | Stauber | ..... | 270/52.19 |
| 6,010,122 | A * | 1/2000 | Weber | ..... | 270/41 |
| 6,082,724 | A | 7/2000 | Kahlig et al. | ..... | 270/52.14 |
| 6,367,792 | B1 | 4/2002 | Chagnon | ..... | 270/5.02 |
| 6,606,944 | B1 * | 8/2003 | Athans et al. | ..... | 101/224 |
| 6,688,224 | B2 | 2/2004 | Herda et al. | ..... | 101/227 |
| 6,733,341 | B1 | 5/2004 | Bugg | ..... | 439/638 |
| 6,733,431 | B2 | 5/2004 | Dufour | ..... | 493/428 |
| 6,752,751 | B2 | 6/2004 | Jackson et al. | ..... | 493/428 |
| 6,935,234 | B2 | 8/2005 | Walczak et al. | ..... | 101/142 |
| 7,611,135 | B2 * | 11/2009 | Kaya | ..... | 270/52.18 |
| 7,931,303 | B2 * | 4/2011 | Steffen | ..... | 281/19.1 |
| 2007/0161486 | A1 * | 7/2007 | Richards | ..... | 493/419 |
| 2008/0136081 | A1 | 6/2008 | Richards | ..... | 270/18 |
| 2008/0231039 | A1 * | 9/2008 | Steffen | ..... | 281/29 |

* cited by examiner

*Primary Examiner* — Ren Yan
(74) *Attorney, Agent, or Firm* — Davidson, Davidson & Kappel, LLC

(57) ABSTRACT

A newspaper is provided. The newspaper includes printed materials. The printed materials have an off-center cross-fold which defines a longer part and a shorter part and an outermost page and an innermost page of the newspaper. The newspaper also includes an adhesive closure for securing the off-center cross-fold. The adhesive closure contacts a short part of the outermost page of the newspaper and a long part of the innermost page of the newspaper. A method for producing a newspaper is also provided.

16 Claims, 3 Drawing Sheets

OFFSET FOLDED NEWSPAPER STABILIZATION METHOD AND PRODUCT

Priority is claimed to U.S. Provisional Application No. 61/192,183 filed on Sep. 16, 2008, the entire disclosure of which is hereby incorporated by reference herein.

BACKGROUND OF THE INVENTION

The present invention relates generally to newspapers, newspaper printing presses and folders, and to a broadsheet newspaper.

U.S. Pat. No. 6,935,234 discloses a newspaper printing press and is hereby incorporated by reference herein described below.

U.S. Pat. Nos. 6,367,792, 6,688,224, 6,733,431 and 6,752,751 disclose folders, and are hereby incorporated by reference herein. U.S. Pat. No. 6,082,724 discloses an inserter for placing inserts in a newspaper jacket.

An unfolded Berliner or midi format newspaper normally measures about 470 mm (18.5 inches) in height and 315 mm (12.0 to 12.5 inches) in width. Several European newspapers, including Le Monde, La Vanguardia, and La Repubblica use this format. The Berliner or midi format is generally cross-folded in addition to being longitudinally folded on the former as opposed to tabloids which are not folded on the former. The cross-fold is generally at the midpoint of the height, i.e. at 235 mm.

BRIEF SUMMARY OF THE INVENTION

The present invention provides a newspaper. The newspaper includes printed materials. The printed materials have an off-center cross-fold which defines a longer part and a shorter part and an outermost page and an innermost page of the newspaper. The newspaper also includes an adhesive closure for securing the off-center cross-fold. The adhesive closure contacts a short part of the outermost page of the newspaper and a long part of the innermost page of the newspaper.

The present invention also provides a method for producing a newspaper having a secure off-center cross-fold, the newspaper including a longer part, an off-center cross-fold and a shorter part. The method includes the step of applying an adhesive closure to a short front page part of the newspaper and a long back page part of the newspaper to secure an off-center cross-fold.

The present invention further provides a method for producing a newspaper having a secure off-center cross-fold including the steps of printing an image on a web, longitudinally folding the web to form a half-fold, cross-cutting the web to form signatures, cross-folding the signatures so the cross-fold is off-center so as to define a longer part and a shorter part and an outermost page and an innermost page and applying an adhesive closure to a short part of the outermost page of the newspaper and a long part of the innermost page of the newspaper to secure the cross-fold.

BRIEF DESCRIPTION OF THE DRAWINGS

Preferred embodiments of the present invention will be elucidated with reference to the following drawings, in which.

DETAILED DESCRIPTION OF A PREFERRED EMBODIMENT

Newspapers having an offset fold may unfold when handled, for example, when gripped or handled by the top of the newspaper, manually or by machine. When the offset-folded newspaper unfolds inserts may be displaced.

Gripping an offset-folded newspaper by the cross-folded edge as opposed to the open top edge prevents a shorter side from unfolding and prevents inserts from being displaced. However, gripping by the cross-folded edge cannot be guaranteed when handling manually, during production or during subsequent transport and delivery. In addition, current manufacturing techniques often rely on gripping newspapers from the top. The existing equipment designed for these manufacturing techniques may not be easy to modify, replace or retrofit in order to grip an offset-folded newspaper by the cross-fold or otherwise to prevent unfolding.

Bagging an offset-folded newspaper may provide a method to prevent unfolding during delivery and transport, however, bagging is not a solution for unfolding during newspaper production or for use with existing manufacturing equipment. Bagging also increases the cost of newspaper production.

Figure 1:
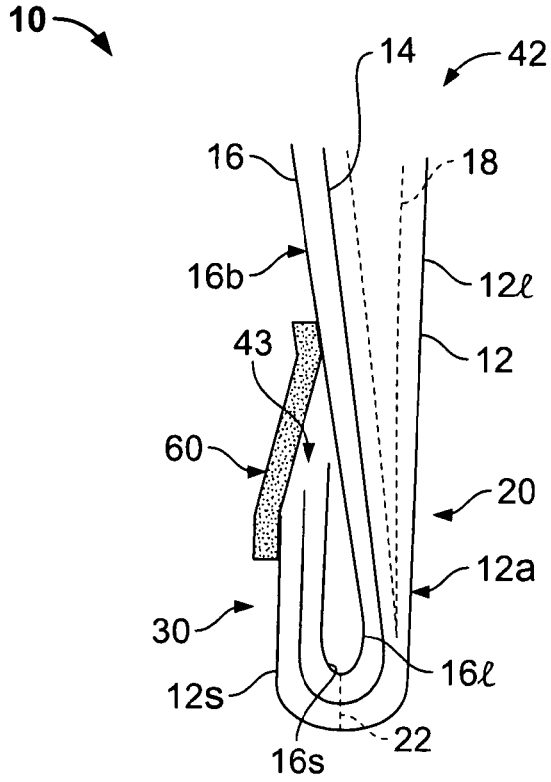
FIG. 1 shows a side view of an offset cross-folded newspaper and an adhesive closure in accordance with the present invention.

A preferred embodiment of the present invention is shown in FIG. 1. A newspaper 10 may include a plurality of separate newspaper sections, for example, first section 12, middle section 14 and back section 16. Each of the separate newspaper sections 12, 14, 16, may include content pertaining to different subject matter, for example, sports, travel, finances, weather, fashion, entertainment, etc. Each of the sections 12, 14, 16 may be longitudinally-folded individually; the sections 12, 14, 16 may also be arranged inside one another and longitudinally-folded as one or any desired combination thereof. Each section 12, 14, 16 may also include a plurality of pages.

Each section 12, 14, 16 includes a front page and a back page. Front section 12 includes a front page 12*a* which may serve as a front page of newspaper 10. In this preferred embodiment, front page 12*a* is also the outermost page 12*a* of cross-folded broadsheet newspaper 10. Back section 16 includes a back page 16*b* which may serve as a back page of newspaper 10. In this preferred embodiment, back page 16*b* is also the innermost page 16*b* of cross-folded newspaper 10. Newspaper 10 has an offset cross-fold 22 defining a longer part 20 on one side of cross-fold 22 and a shorter part 30 on the other side of cross-fold 22. Consequently, cross-fold 22 defines a long page part and short page part for each page in newspaper 10. Thus, front page 12*a* includes long front page part 12*l* and a short front page part 12*s* and back page 16*b* includes a long back page part 16*l* and a short back page part 16*s*.

Inserts 18 may be tucked or deposited between sections 12, 14, 16, for example, between first section 12 and middle section 14, or between long back page part 16*l* and a short back page part 16*s* or any combination thereof.

Newspaper 10 may have a height of, for example, 14.67 inches, when cross-fold 22 is unfolded and newspaper 10 lays flat. Cross-fold 22 may be located at a height of, for example, 4.17 inches or 10.5 inches, from a top edge 42 or a gripped edge 43 of newspaper 10. Cross-fold 22 may be located at a height of 33% or less of a height of newspaper 10. Specifically, cross-fold 22 may be located at a height of 28.4% of a height of newspaper 10, for example. Cross-fold 22 also may be located at a height of 67% or more of a height of newspaper 10. In accordance with the preferred embodiment shown in FIG. 1, longer part 20 has a height of, for example, 10.5 inches, and shorter part 30 has a height of, for example, 4.17 inches.

As shown in FIG. 1, an adhesive closure 60 is applied to short front page part 12*s* and an exposed portion of long back page part 16*l* which is visible behind shorter part 30 (FIG. 2) thereby preventing cross-fold 22 from unfolding and shorter part 30 from dropping down.

Figure 2:
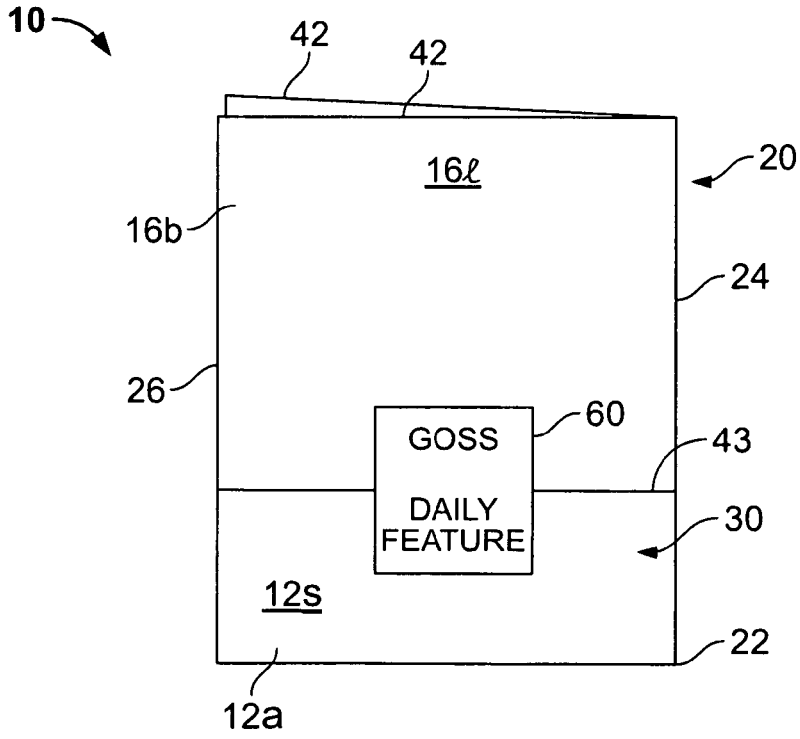
FIG. 2 shows a back view of the newspaper and adhesive closure shown in FIG. 1.

FIG. 2 shows a back view of newspaper 10 including longitudinally-folded edges 24 of each section 12, 14, 16 and open edges 26 of each section 12, 14, 16. Adhesive closure 60 is applied to short front page part 12*s* and long back page part 16*l* to prevent cross-fold 22 from unfolding. Adhesive closure 60 may be printed as desired or blank. A size of adhesive closure 60 may be designed and selected as desired.

Figure 3:
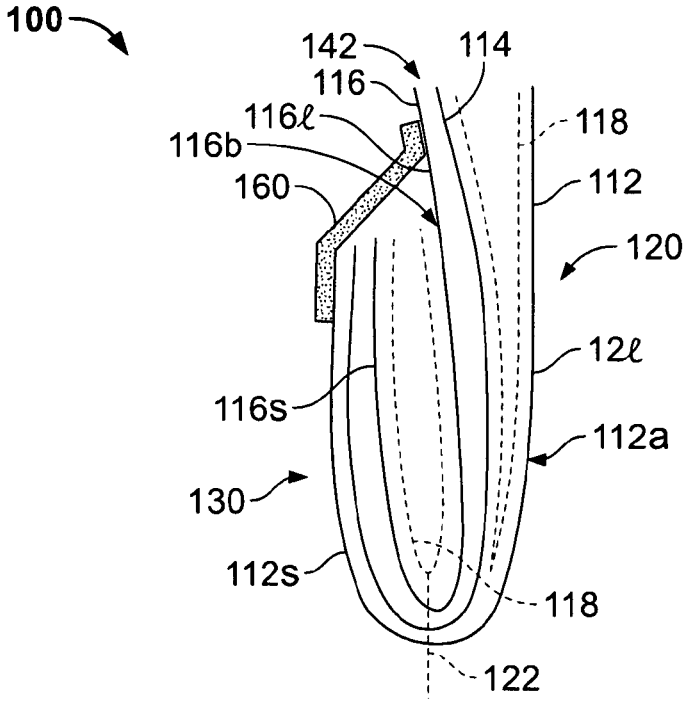
FIG. 3 shows a side view of an offset cross-folded newspaper and an adhesive closure in accordance with a further embodiment of present invention.
Figure 4:
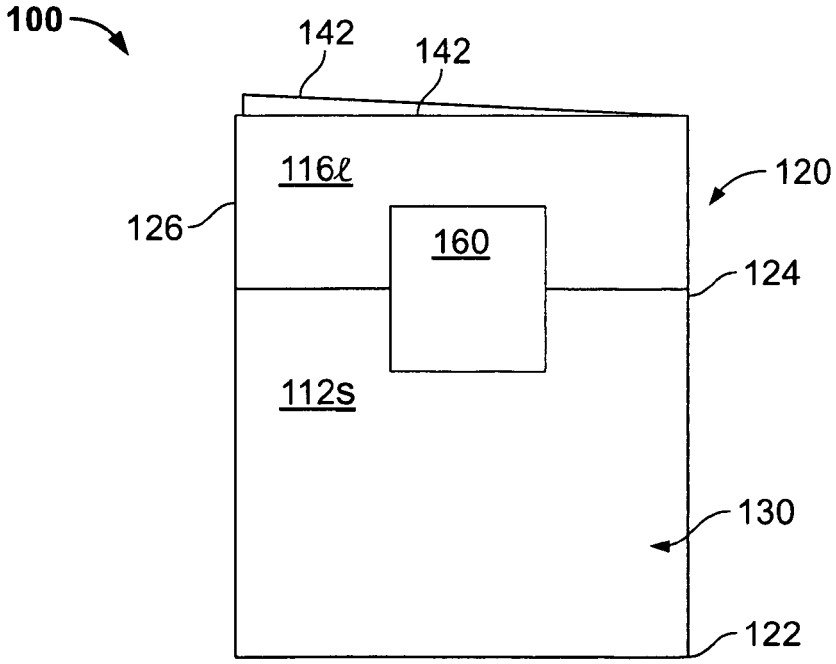
FIG. 4 shows a back view of the newspaper and adhesive closure shown in FIG. 3.

Another preferred embodiment in accordance with the present invention is shown in FIGS. 3 and 4. In FIGS. 3 and 4 a newspaper 100 is a Berliner style newspaper, longitudinally folded, having a total height of, for example, 18.5 inches when newspaper 100 is not cross-folded at a cross-fold 122. Newspaper 100 includes a plurality of separate newspaper sections, front section 112, middle section 114 and back section 116. The plurality of separate newspaper sections 112, 114, 116 may be stacked together then cross-folded together. Each section 112, 114, 116 includes a front page and a back page. Front section 112 includes a front page 112*a* which may serve as a front page of newspaper 100. In this preferred embodiment, front page 112*a* is also the outermost page 112*a* of cross-folded newspaper 10. Back section 116 includes a back page 116*b* which may serve as a back page of newspaper 100. In this preferred embodiment, back page 116*b* is also the innermost page 116*b* of cross-folded newspaper 10.

Newspaper 100 has an offset cross-fold 122 defining a longer part 120 on one side of cross-fold 122 and a shorter part 130 on the other side of cross-fold 122. Consequently, cross-fold 122 defines a long page part and short page part for each page in newspaper 100. Thus, front page 112*a* includes long front page part 112*l* and a short front page part 112*s* and back page 116*b* includes a long back page part 116*l* and a short back page part 116*s*. Cross-fold 122 for newspaper 100 may be, for example, 10.5 or 8.0 inches from a top edge 142 of newspaper 100 and is perpendicular to a longitudinal fold 124 (FIG. 4).

Longer part 120 has a height of, for example, 10.5 inches and shorter part 130 has a height, for example, 8.0 inches. Inserts 118 may be tucked or deposited between different sections 112, 114, 116 or between long back page part 116*l* and a short back page part 116*s* or any combination thereof.

As shown in FIGS. 3 and 4, an adhesive closure 160 is applied to short front page part 112*s* and an exposed portion of long back page part 116*l* which is visible behind shorter part 30 (FIG. 2) thereby preventing cross-fold 122 from unfolding and shorter part 130 from dropping down.

FIG. 4 shows a back view of newspaper 100 including a longitudinally-folded edges 124 of each section 112, 114 and 116 and open edges 126 of each section 112, 114, 116. Adhesive closure 160 may be printed as desired or blank. A size of adhesive closure 160 may be designed and selected as desired.

Due to the prominent positioning of the adhesive closure and the necessary manual removal of the adhesive closure in order to open the newspaper, the closure may be a prime location for premium advertising, or reference contents of particular interest in the newspaper. If the closure is blank or suitably preprinted at the time of application, the closure may include variable data associated with a particular reader or subscriber subsequently added, for example, at the time of product addressing. The closure may be printed by ink jetting or any of successor technology.

Figure 5:
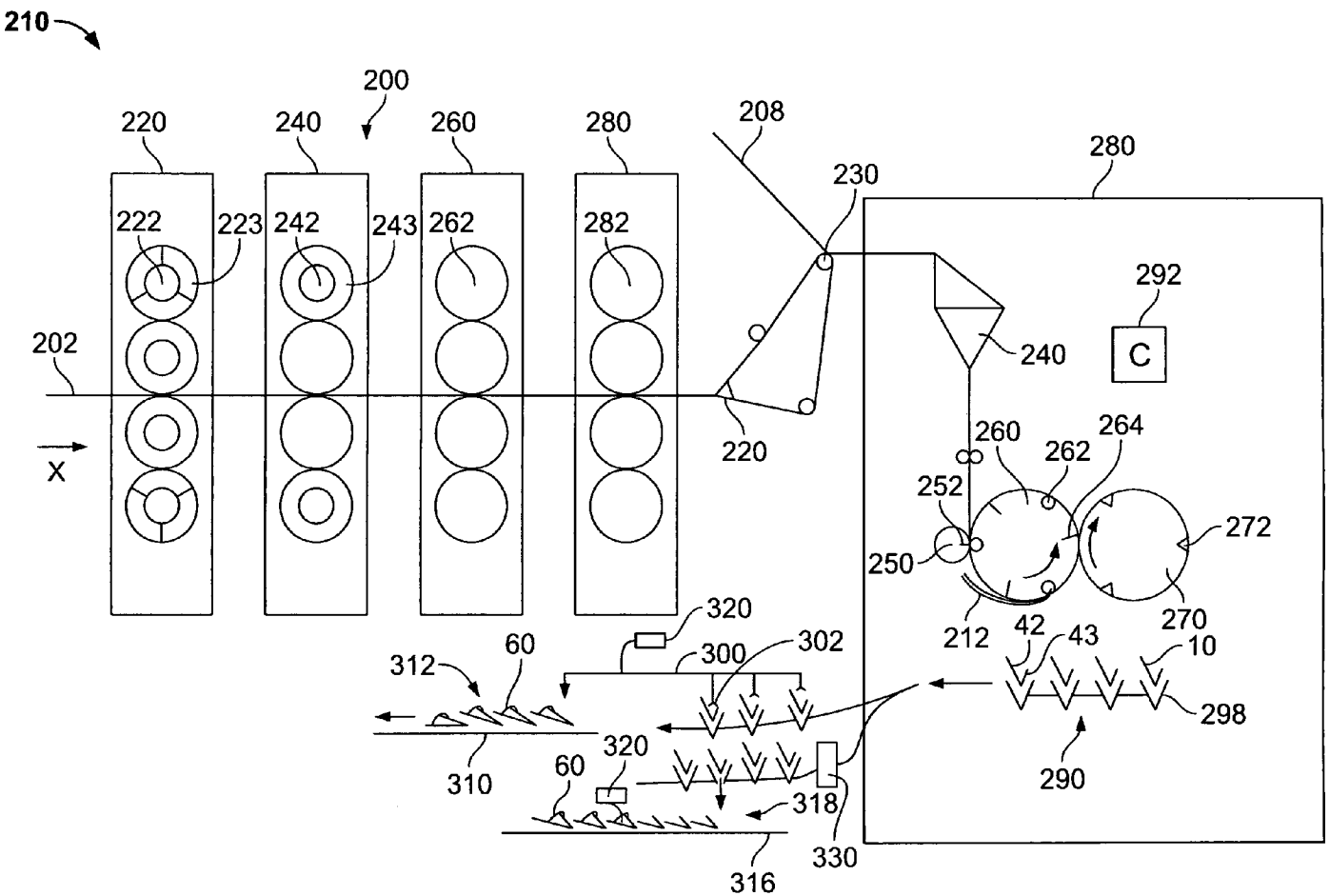
FIG. 5 shows a printing press for producing the newspapers shown in FIGS. 1 and 3.

FIG. 5 shows a broadsheet newspaper printing press 210 having a printing section 200 which may be for example, an offset, perfecting, lithographic web printing section printing in a plurality of colors, for example, cyan, magenta, yellow and black. Each printing unit 220, 240, 260, 280 may print a different color on a web 202. Each printing unit 220, 240, 260, 280 may have corresponding plate cylinders 222, 242, 262, 282 carrying printing plates, for example, printing plates 223, 243 on plate cylinders 222, 242 respectively. Plate cylinders 242 may be a one around plate cylinder and printing plates 243 may have a 44-inch circumference. In another preferred embodiment, plate cylinders 222 carry three images via printing plates 223. Web 202 may be 48 inches wide.

Web 202 travels from printing section 200 to a folder 280 in a direction X. Web 202 may be slit by a slitter 220 into ribbons which are recombined, potentially with other ribbons 208, at a roller 230. Ribbons of web 202 then enter folder 280 and pass to a former board 240 for longitudinal folding. The ribbons are folded in half, longitudinally, in the direction of travel. (See longitudinally-folded edges 24, 124 in FIGS. 2 and 4, respectively). A cross cutter 250 including a knife blade 252 cuts ribbons into broadsheet newspapers 212, which are gripped at a lead edge by a gripper 262 on a tucker cylinder 260. Grippers 262 may be, for example, pins or a hold-down device for pinless gripping. Cross cutter 250 rotates clockwise, tucking cylinder 260 rotates counter-clockwise and a jaw cylinder 270 rotates clockwise. A tucking blade 264 on tucking cylinder 260 tucks a gripped newspaper 212 into a jaw 272 of jaw cylinder 270 forming a cross fold 212 in newspaper 212 and forming a broadsheet newspaper 10. (See cross-fold 22 in FIGS. 1 and 2 and cross-fold 122 in FIGS. 3 and 4).

In the preferred embodiment shown in FIG. 1, newspaper 212 is cut by cross cutter 250 to have a total height of, for example, about 14.67 inches. Since longer section 20 is desired having a length of, preferably, 10.5 inch, the distance between a gripper 262 and a gripped edge 43 (See FIGS. 1, 2) of newspaper 212 and tucker blade 264 is approximately 4.17 inches or less so the distance between tucker blade 264 and top edge 42 (See FIGS. 1, 2) is 10.5 inches or more. A controller 292 can set the phasing between the grippers 262 and tuckers 264 of tucking cylinder 260, and control the phasing of jaws 272 of jaw cylinder 270, so that a cross-fold distance can be set.

Broadsheet newspapers 10 are removed from jaw cylinder 270 and transported downstream to, for example, a fan wheel, a belt conveyor, a gripper pick-up, and then delivered to an inserter with a pocket conveyor 290 including a plurality of pockets 298, only the pocket conveyor 290 being shown here for simplicity. The fan wheel and belt conveyor are shown for example in U.S. Pat. No. 6,733,341, hereby incorporated by reference herein. Inserts 18 (FIG. 1) may be placed into newspapers 10 downstream by, for example, a hopper mechanism of the inserter.

Adhesive closures 60 (FIGS. 1 and 2) may be applied to newspaper 10 downstream of the inserter. From pocket conveyor 290 newspapers 10 may be deposited onto a belt conveyor 310 in a lapped stream 312 via a gripper conveyor system 300 which includes grippers 302. Adhesive closures 60 also may be applied to newspapers 10 by a machine applicator 320 while being gripped by grippers 302 and transported by gripper conveyor system 300. Adhesive closures 60 also may be applied to newspapers 10 after newspapers have been deposited on conveyor 310 by a machine applicator 320 located further downstream.

Alternatively, pocket conveyor 290 may transport newspapers 10 to an inserter 330 in which newspapers 10 receive inserts 18. Inserts 18 may be customized for recipients. Pockets 298 may be bottom-release pockets. Newspapers 10 may be released from pockets 298 and deposited onto a belt conveyor 316 in a lapped stream 318. Adhesive closures 60 may then be applied to newspapers 10 in lapped stream 318 by a machine applicator 320.

Furthermore, application of adhesive closures 60 may be done by any way as known in the art. Application may occur between printing press 210 and a downstream packaging center or after inserting.

The adhesive closure may be a sticker. The adhesive closure may be pre-printed. The Adhesive closure may be blank, partially, preprinted, and/or printed subsequently with data specifically of interest to one or more readers or include information about the reader and/or subscriber. A database and associated data management system may be used for printing the data specifically of interest to one or more readers. The adhesive closure may be printed using ink-jetting.

The adhesive closure may be pressed on the newspaper. The adhesive closure may be applied during transport of the newspaper. The adhesive closure may be applied as part of the inserting process. The adhesive closure may be applied at the time of address labeling. The sticker may be printed at the time of address labeling.

A newspaper including a sticker is also provided. In addition, a method of applying an adhesive closure or sticker to provide stability for a newspaper is provided.

In a first alternative embodiment, the front page of the newspaper may also be located where back page 116*b* is in the FIG. 1 embodiment. In a second alternative embodiment, shorter part 30 may be folded in front of longer part 20 as opposed to behind longer part 20 which is shown in FIG. 1.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method for producing a newspaper having a secure off-center cross-fold comprising the step of:

printing an image on a web with a printing section of a printing press;

longitudinally folding the web with a former located downstream of the printing section to form a half-fold;

cross-cutting the web to form signatures;

cross-folding the signatures with a folder so the cross-fold is off-center so as to define a longer part and a shorter part and an outermost page and an innermost page; and applying an adhesive closure with a machine applicator to the outermost page only on a short part of the outermost page of the newspaper and to the innermost page only on a long part of the innermost page of the newspaper below a top edge of the long part of the innermost page to secure the cross-fold, the machine applicator located downstream of the folder.

2. The method for producing a newspaper recited in claim 1 wherein the cross-fold is located 10.5 inches from a top edge of the signatures.

3. The method for producing a newspaper recited in claim 1 wherein the longer part has a height of 10.5 inches.

4. The method for producing a newspaper recited in claim 3 wherein the shorter part has a height of approximately 4.17 inches.

5. The method for producing a newspaper recited in claim 1 wherein the shorter part has a height of approximately 8.0 inches.

6. The method for producing a newspaper recited in claim 1 wherein the step of cross-cutting includes cutting the web into signatures having a height of approximately 18.5 inches.

7. The method for producing a newspaper recited in claim 1 wherein the signatures are cross-folded at a height of 33% or less or 67% or more.

8. The method for producing a newspaper recited in claim 1 further comprising the step of depositing inserts into the newspaper.

9. The method for producing a newspaper recited in claim 1 wherein the adhesive closure is a preprinted sticker.

10. The method for producing a newspaper recited in claim 1 wherein the outermost page is a front page of the newspaper.

11. The method for producing a newspaper recited in claim 1 wherein the innermost page is a back page of the newspaper.

12. The method for producing a newspaper recited in claim 1 further comprising the step of transporting the newspaper on a conveyor located downstream of the folder.

13. The method for producing a newspaper recited in claim 12 wherein the conveyor is a gripper conveyor, pocket conveyor or belt conveyor.

14. The method of claim 12, wherein the step of applying comprises applying with the machine applicator while the newspaper is on the conveyor.

15. The method of claim 1, wherein the step of applying comprises applying with the machine applicator while the newspaper is in a lapped stream of newspapers on a conveyor, the conveyor located downstream of the folder.

16. The method of claim 1, wherein the step of applying comprises applying with the machine applicator while the newspaper is gripped by grippers of a gripper conveyor system, the gripper conveyor system located downstream of the folder.

* * * * *